US005655971A

United States Patent [19]

Wayne

[11] Patent Number: 5,655,971

[45] Date of Patent: Aug. 12, 1997

[54] VARIABLE CONTOUR PRACTICE PUTTING GREEN

[76] Inventor: Ronald Wayne, 12103 Pierson, Detroit, Mich. 48228

[21] Appl. No.: 720,290

[22] Filed: Sep. 26, 1996

[51] Int. Cl.[6] ..... A63B 67/02; A63B 69/36

[52] U.S. Cl. ..... 473/160; 473/163; 473/171; 473/279

[58] Field of Search ..... 473/160, 163, 473/171, 279

[56] References Cited

U.S. PATENT DOCUMENTS

| | | | |
|---|---|---|---|
| 3,690,673 | 9/1972 | Occhipinti | 473/160 |
| 3,892,412 | 7/1975 | Koo | 473/160 |
| 5,441,265 | 8/1995 | Codlin | 473/160 |

*Primary Examiner*—George J. Marlo
*Attorney, Agent, or Firm*—John R. Benefiel

[57] ABSTRACT

A practice putting green which includes a generally planar slab of rigid light weight material;

a foam rubber pad installed on the upper surface of said pad;

a covering layer of artificial turf attached to an upper surface of said pad;

at least one target hole in said turf layer and pad; and at least one variable contour installation comprising a sealed cavity in said rubber pad and means for selectively pressurizing said cavity to cause upward bulging of said turf layer to provide a variable contour putting surface.

5 Claims, 2 Drawing Sheets

VARIABLE CONTOUR PRACTICE PUTTING GREEN

BACKGROUND OF THE INVENTION

This invention concerns putting greens for golf, and more particularly artificial practice greens which are designed to allow variety of surface contours to be selectively established for putting practice.

U.S. Pat. No. 3,892,412 issued on Jul. 1, 1975 and U S. Pat. No. 3,690,673 issued on Sep. 12, 1972 both describe such a practice putting green using inflatable air bags or bladders which can be inflated to create various contours on a synthetic turf surface.

Such inflatable air bladder designs limit the shape of the particular contours achievable, and the cost of constructing a practice putting green using separate air bladders is high and the bladders wear out and are difficult to replace.

The object of the present invention is to provide a practice putting green with selectively variable contours which allows a great variation in the shape of the contours, and which can be constructed at low cost.

SUMMARY OF THE INVENTION

The above object is achieved by a practice putting green construction comprised of a backing slab of a light weight material such as STYROFOAM™ overlain by an attached thick foam rubber pad having artificial turf layer bonded to a thin backing sheet. The foam rubber pad has a plurality of partial depth sealed cavities cut out in various pattern shapes. Each cavity is adapted to be pressurized via a respective fluid conduit extending through the backing slab to a inflation valve, allowing variable manual pressurization causing bulging of the turf in a variety of contours.

A plurality of holes are distributed around the top of the putting green, with a ball return bore extending to the backing slab perimeter.

DETAILED DESCRIPTION

Figure 1:
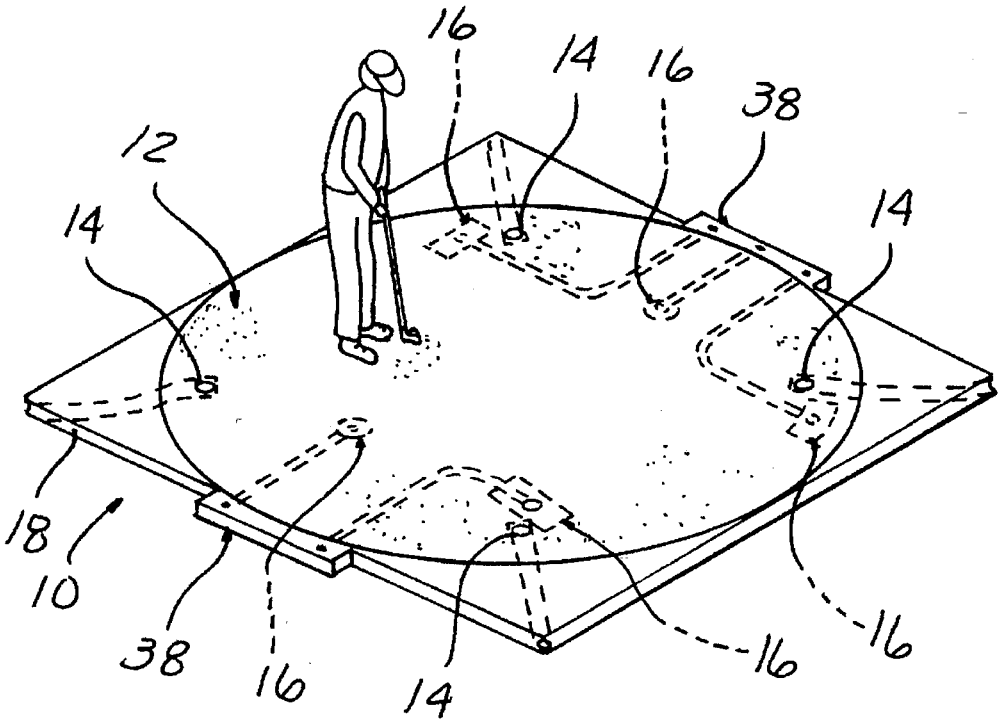
FIG. 1 is a perspective view of the practice putting green according to the invention.
Figure 2:
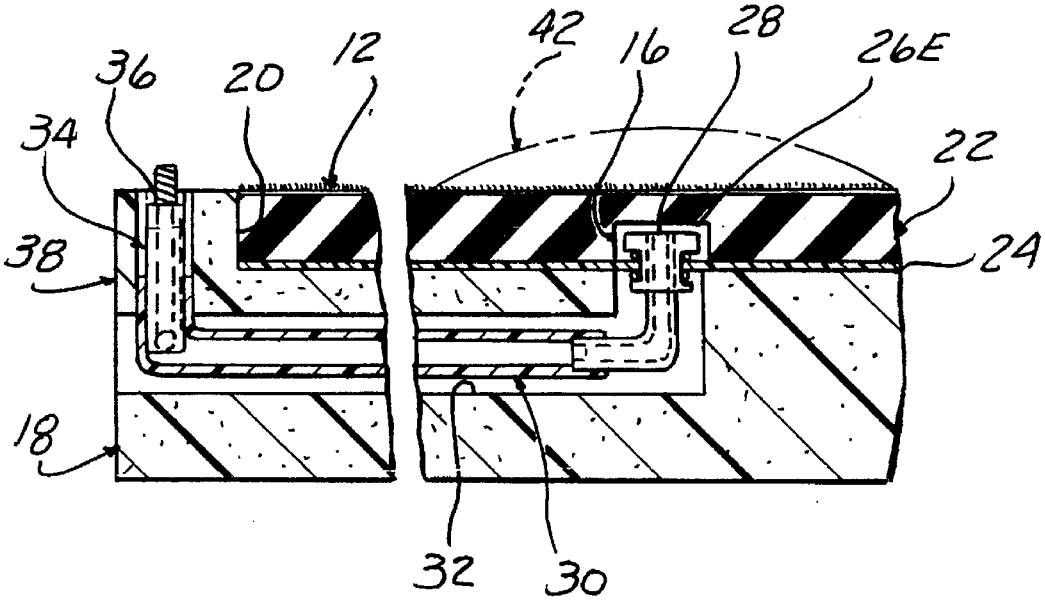
FIG. 2 is a plan view of the putting tee.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the practice putting tee 10 comprises a large, generally square flat structure adapted to lie on a floor or the surface of a portion of the ground.

A large circle 12 (12 ft. diameter) of an artificial turf layer is inlaid into the surface of the structure. The artificial turf layer is sold commercially with an attached thick rubber pad under the trademark MONOGRASS™ by Playfield Industries of Chatsworth, Ga.

Four target holes 14 are arranged around the turf circle 12 at the corners of the practice green 10.

Variable contour installations 16 are arranged in various locations.

The practice green structure includes a generally rectangular slab 18 of a lightweight rigid material such as STYROFOAM™ having a circular recess 20 in which a thick foam rubber pad 22 is received. Pad 22 has the artificial turf layer 12 bonded to its upper surface, and a thin rigid plastic backing layer 24 is bonded to the lower surface using an epoxy cement such as used for golf shafting. The backing layer 24 is in turn fixed to the upper surface of the slab 18 using the same adhesive.

Each variable contour installation comprises a cavity 26A–26E extending into the foam rubber pad 22, for a portion of the thickness. If the total thickness of the pad is on the order of ¾ to 1 inch, each cavity 26A–26E is approximately one half of that thickness.

Each cavity 26A–26E is adapted to be individually pressurized to a selectively controllable level by a fluid conduit system including a sealed fitting 28 retained and sealed in a hole in the backing layer 24. A hose 30 disposed in a bore 32 in the slab 18 connects fitting 28 to an exposed air fill Schroeder valve 34 located projecting upwards in a bore 36 in one of two fill valve sections 38 at the perimeter of the slab 18. The air fill valve 34 is fixed using a high strength epoxy sealant and adhesive which also attaches the hose 30 to the valve 34 and fitting 28. Such adhesive is available from Conad, Inc. as an epoxy repair kit. The air fill valve is a standard Schroeder valve configuration used for inflating tires, etc.

Figure 3:
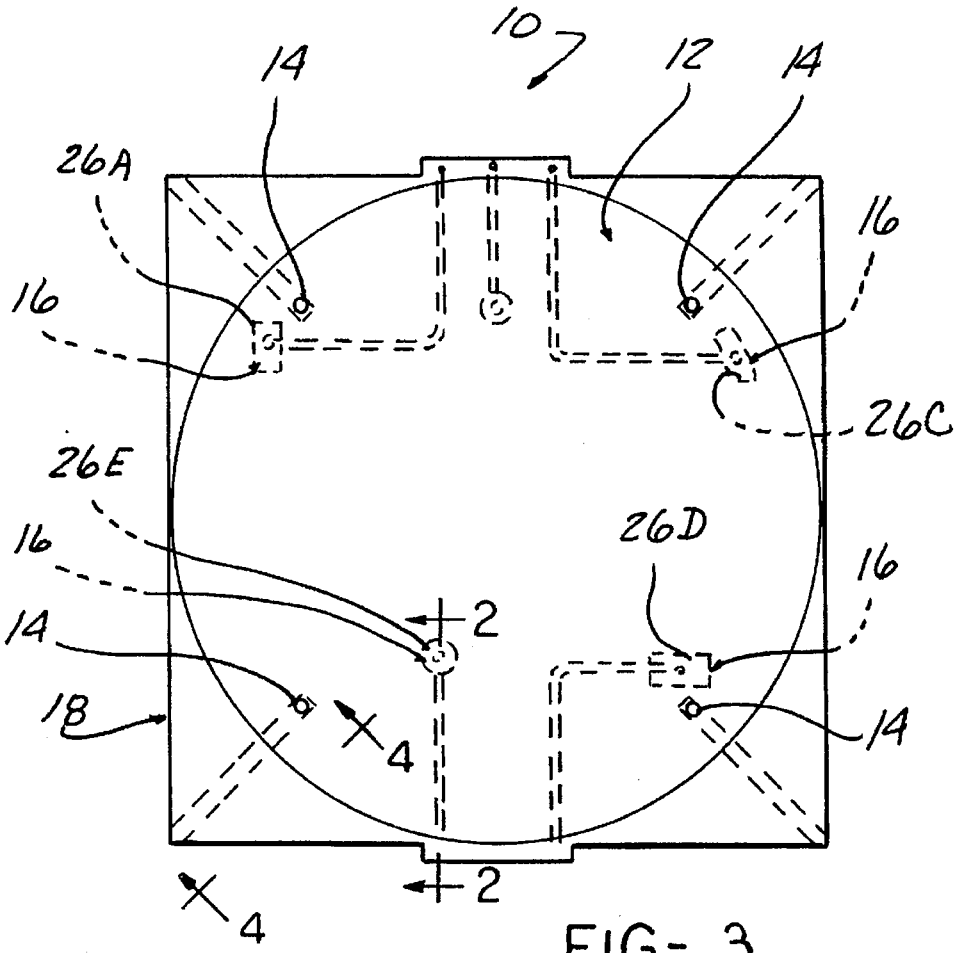
FIG. 3 is a fragmentary sectional view of a portion of the putting tee.

This allows air pressure developed by a manual air pump to controllably expand cavities 26A–26F, which causes a bulging of the artificial turf 12 above the respective cavity 26A–26E as indicated in FIG. 3. The shape of the bulging contour varies with the configuration of each cavity. Thus a variable putting contour 42 is established around each of the installations 16, which allows a variety of putting challenges for the user.

Figure 4:
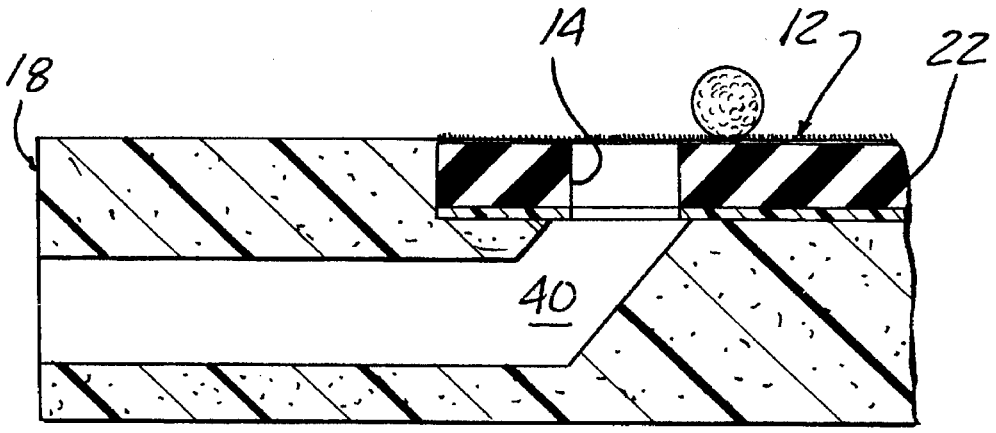
FIG. 4 is a fragmentary sectional view of the practice green shown in FIGS. 1 and 2.

As seen in FIG. 4, a ball return is provided by a bore 40 beneath each hole 14 extending out to the perimeter of the slab 18.

I claim:

1. A practice putting green comprising:

a generally planar slab of rigid light weight material;

a foam rubber pad installed on the upper surface of said pad;

a covering layer of artificial turf attached to an upper surface of said pad;

at least one target hole in said turf layer and pad;

at least one variable contour installation comprising a sealed cavity in said rubber pad and means for selectively pressurizing said cavity to cause upward bulging of said turf layer to provide a variable contour putting surface.

2. The practice putting green according to claim 1 wherein a plurality of said variable contour installations are provided, each including a cavity in said rubber pad, wherein at least some of said cavities are of varying sizes and perimeter shapes.

3. The practice putting green according to claim 1 wherein said rubber pad is bonded to a backing layer extending over said cavity, a fitting installed in said backing layer protruding into said cavity, and a fluid conduit extending through said slab to an air fill valve exposed at the perimeter of said slab.

4. The practice putting green according to claim 3 further including a ball return bore in said slab extending from said target hole to the perimeter of said slab.

5. The practice putting green according to claim 1 wherein said thick rubber pad is of a thickness on the order of ¾ to 1 inch, and is recessed into said slab.

* * * * *